United States Patent [19]

Laauwe

[11] 3,990,639

[45] Nov. 9, 1976

[54] AEROSOL VALVE ACTUATOR

[76] Inventor: Robert H. Laauwe, 237 Green Ridge Road, Franklin Lakes, N.J. 07417

[22] Filed: Jan. 19, 1976

[21] Appl. No.: 650,053

[52] U.S. Cl. ..... 239/492; 239/539; 222/402.11

[51] Int. Cl.[2] ..... B05B 1/34

[58] Field of Search ..... 239/539, 492, 457; 222/402.11

[56] References Cited

UNITED STATES PATENTS

| | | | |
|---|---|---|---|
| 2,984,420 | 5/1961 | Hession, Jr. | 239/492 |
| 3,913,803 | 10/1975 | Laauwe | 222/402.11 |
| 3,913,804 | 10/1975 | Laauwe | 222/402.11 |

*Primary Examiner*—Allen N. Knowles
*Attorney, Agent, or Firm*—Kenyon & Kenyon Reilly Carr & Chapin

[57] ABSTRACT

An aerosol valve actuator, which can also be used for pump-type fluid product dispensing packages, is made from only two molded parts which are screwed together. By screwing and unscrewing the two parts, sprays ranging from a mist to a solid stream, as well as a positive shut-off, can be obtained.

4 Claims, 10 Drawing Figures

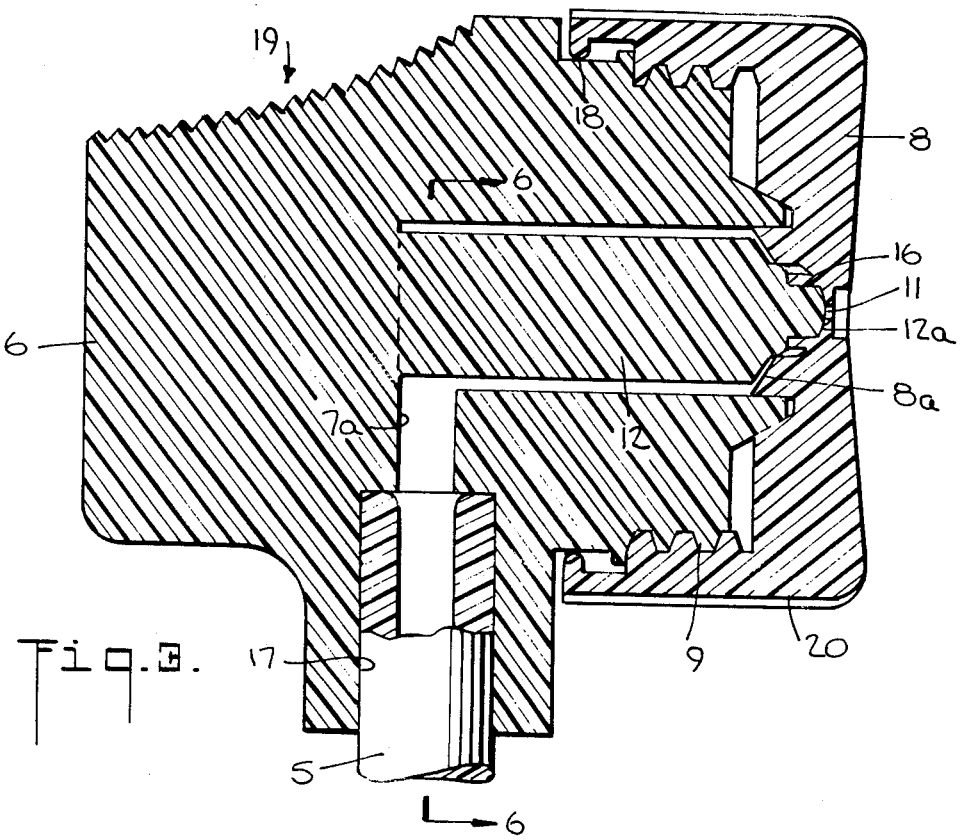
Fig. 3.
Fig. 4.
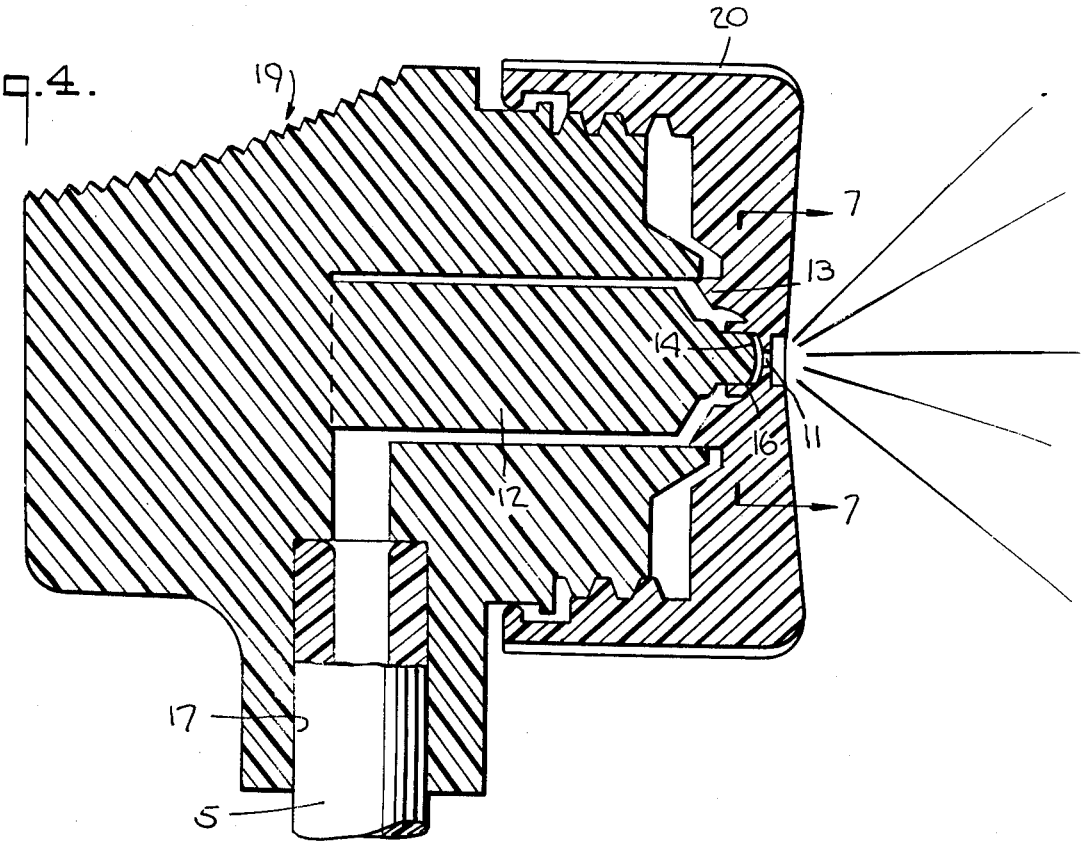

AEROSOL VALVE ACTUATOR

BACKGROUND OF THE INVENTION

Both aerosol packages and pump packages of fluid products, commonly have a tubular dispensing stem through which the packaged product is expelled when the stem is moved, usually by depression of the stem. In the case of an aerosol package with the product pressurized, the stem movement opens an aerosol valve, and in the case of the pump-type package, depression of the stem works a mechanical pump which pressurizes and expells the product.

Because the tubular stem is normally moved by finger pressure, it is common to provide an actuator fixed to the top of the stem, both for providing for comfortable finger-pressure actuation of the stem and to provide an orifice or nozzle through which the product expelled into the actuator by movement of the stem, can discharge into the atmosphere with a spray pattern having the characteristics desired for the particular product discharged.

With product formulations which contain a liquified gas propellant, the explosive vaporization of the propellant and product when leaving the actuator orifice, is relied on to obtain the spray pattern desired, this permitting a very simple actuator design to be used. In the case of other product formulations such as those not containing a liquified gas propellant, mechanical breakup actuators have been used, which incorporate a swirl chamber in which the product is swirled as it is forced through the actuator so that the combined motions of swirling and axial flow through the actuator orifice, provide a mechanical breakup of the product and the consequent production of a spray having a pattern determined by the design of the actuator.

Some products have a tendency to clog the actuator and its orifice, and various so-called tip-sealing actuators have been proposed wherein the actuator orifice or nozzle is sealed automatically after each use, so that any product remaining within the actuator is sealed off from the outside atmosphere, it being air and/or evaporation into the air that causes clogging problems.

Examples of actuators emobdying the features of both a swirl chamber and tip sealing are provided by the present inventor's own U.S. Pat. Nos. 3,913,803 and 3,913,804, both issued Oct. 21, 1975. The constructions of both of these patents provide for automatic tip sealing, the provision of a swirl chamber, and the possibility of complete shut-off as is desirable for shipment of packages of the dispensing type.

Manufacturing costs of such actuators, whether for aerosol or pump-type packages, is an extremely important consideration, keeping in mind that such packages are produced in quantities running into many millions. To keep this cost down, it is desirable that if an actuator is to provide both a swirl chamber, always desirable and sometimes necessary, in conjunction with a positive shut-off, it is of prime importance that the construction involve as few parts as possible, that the parts can be made by high-production methods, particularly by injection-molding, since plastic parts are usually preferred, and that assembly of the parts involved be free from complications.

Anyone unfamiliar with the aerosol industry and the actuators referred to hereinabove, can refer to the text AEROSOLS: SCIENCE AND TECHNOLOGY, published by Interscience Publishers, Inc., New York, copyright 1961, with the understanding that aerosol packaging, due to possibly undeserved adverse publicity, is to some extent giving way to pump-type packages, which insofar as actuators are concerned, involve similar problems. The main difference is that in an aerosol package the aerosol valve has a tubular stem through which the packaged product is expelled when the stem is depressed, whereas in the pump-type package depression of a generally corresponding tubular stem, operates a mechanical pump which expells the packaged product through the stem. In both cases the product is expelled under pressure through the stem.

SUMMARY OF THE INVENTION

The object of the present invention is to provide an actuator made of the fewest possible parts, with parts that can be made in large quantities by conventional injection-molding techniques, and which, in spite of great simplicity, reliably provides for a positive shut-off, plus a swirl chamber which not only performs its usual function, but also which can be governed so that the expelled product through the actuator is in a form varying from a fine mist to a solid stream.

To attain this object, the present invention requires only two parts. These are male and female parts having screw threads and which are screwed together and form a body having front and back walls, the distance between these walls being variable by screwing the parts back and forth relative to each other.

The male part internally forms a passage axially with respect to the screw threads of both parts, this passage extending to a first one of the walls and this wall having a product-discharge orifice formed through it substantially coaxial with the passage through the actuator. The second of the walls has a probe projecting from it coaxially with the screw threads through the passage and having a front end which when the parts are screwed tightly together, seats tightly on the inside of the first wall around its orifice to provide the desirable positive orifice shut-off.

In addition, the first wall having the orifice, internally has baffles extending inwardly from around the orifice and forming a cylindrical chamber having one or more tangential side inlets which communicate with the passage in the actuator, thus providing the desirable swirl chamber.

In addition, the front end of the probe providing the shut-off feature is made cylindrical and slidably fits into the swirl chamber so that by screwing the two parts back and forth, the probe slides back and forth in the swirl chamber to vary the effective flow area of the inlet or inlets to the chamber. Thus, by simply screwing the two parts of the actuator relative to each other, not only the inlet flow to the swirl chamber can be changed, but also the size of the chamber itself because this chamber is formed between the front end or tip of the probe and the wall in which the orifice is formed.

If the two parts are unscrewed so that the probe tip is withdrawn a maximum possible distance, the inlet or inlets to the swirl chamber become of such large size that the swirl chamber can completely fill with solid fluid product, thus destroying its effect as a swirl chamber and resulting in the ejection through the actuator orifice of a solid far-reaching steam of product. At the other extreme, if the two parts are screwed almost together, close to the nozzle shut-off point, the inlet or inlets to the swirl chamber are of minimum size and the swirl chamber has a minimum volume area, this increasing the swirling velocity and resulting in the ejection of a fine mist through the actuator's orifice. Complete screwing of the parts tightly together, of course, provides a positive shut-off.

This new actuator has the usual hole by which the actuator can be press-fitted to the tubular product dispensing stem, and which, in this case, communicates with the previously referred to passage. This hole would normally be in the actuator's male part which would normally be stationary, it being the female part which can be made in the form of a screw cap, and by appropriate design screwed either to the front or back of the male part, while providing the organization previously described. Particularly in the case of the pump-type package, the expulsion pressure applied to the product is variable, it depending on the finger pressure of the user. With this new actuator, by screwing the parts one way or another, the user can ordinarily be expected to obtain either the solid stream or spray pattern or cone angularity desired, substantially regardless of the pressure on the product being discharged through the actuator.

BRIEF DESCRIPTION OF THE DRAWINGS

A specific example of the present invention is illustrated by the accompanying drawings, in which:

FIG. 3 is a vertical section through the actuator of FIGS. 1 and 2, here shown in the shut-off position with the two parts screwed tightly together;

FIG. 4 is the same as FIG. 3 but shows the two parts unscrewed just enough to provide for a spray of wide cone angularity and, therefore, being in the nature of a fine mist;

DETAILED DESCRIPTION OF THE INVENTION

Figure 2:
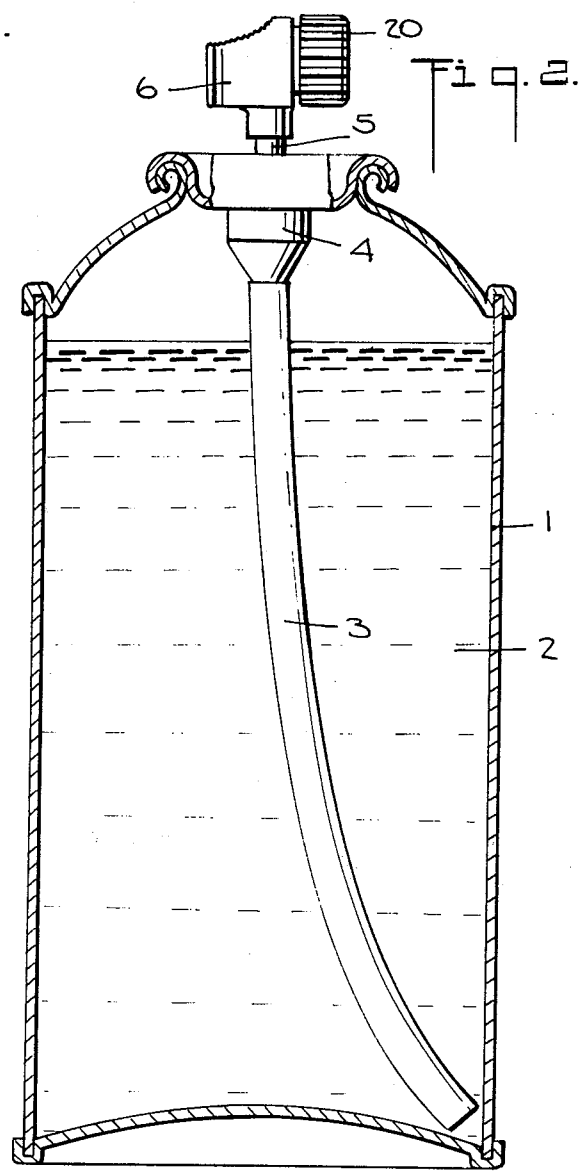
FIG. 2 is a vertical section.
Figure 1:
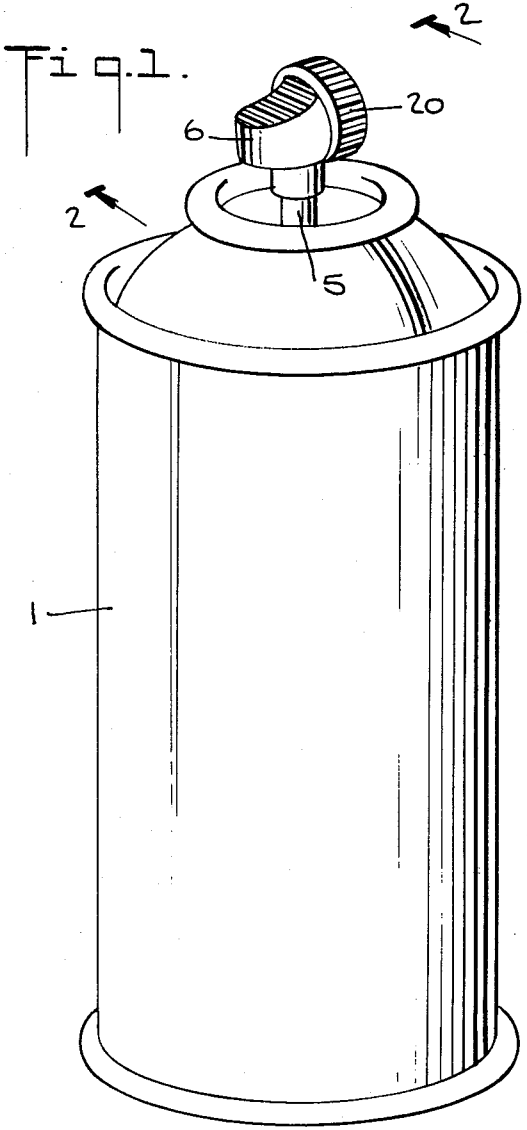
FIG. 1 is a perspective view showing an aerosol package to which the new actuator is applied, keeping in mind that the pump-type package would look almost the same.

Having reference to these drawings, FIGS. 1 and 2 show a typical aerosol can 1 containing a liquid product 2 charged with a liquified gas propellant and which is forced through a dip tube 3 when the aerosol valve 4 is opened by depression of its tubular valve stem 5 through which the product then discharges. In the case of the pump-type package the mechanical pump exterior looks very much like the aerosol valve 4. In either case, when the tubular valve stem 5 is depressed, the product 2 is expelled through the stem in a pressurized condition, either via the gas propellant or the mechanical action of the pump.

The new actuator is shown at 6 press-fitted on this tubular stem 5 in the usual manner.

Figure 5:
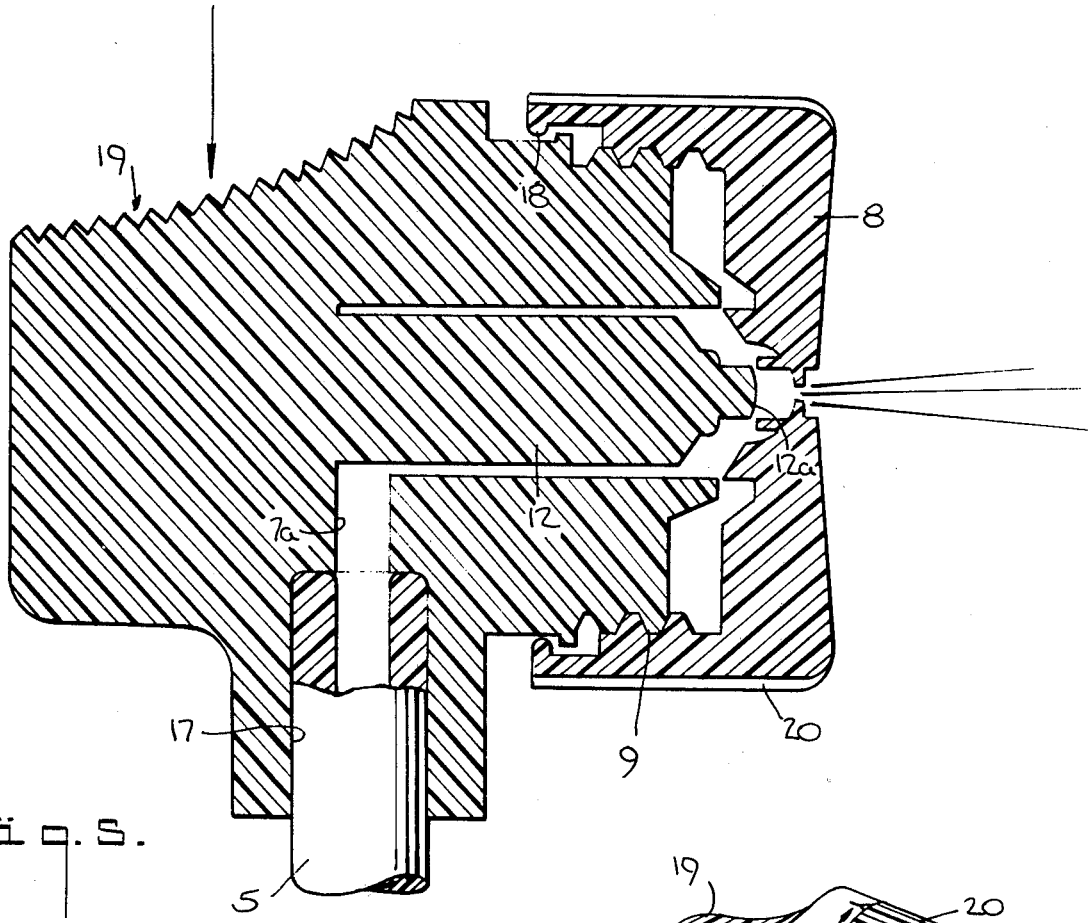
FIG. 5 is the same as FIG. 3 but shows the two parts unscrewed to their maximum so as to result in flooding of the swirl chamber with solid product and the consequent ejecting of a solid stream of product, having a very narrow cone angularity.

Going now to FIGS. 3 through 5, the new actuator is shown as comprising a male part 7 and a female part 8, these parts having screw threads 9 by which they are screwed together to form a body having a front wall 8*a* and a back wall 7*a*, the distance between these walls being variable by screwing the parts 7 and 8 back and forth relative to each other.

The male part 7 internally forms a passage 10 coaxially with respect to the screw threads 9 and extending to a first one of the walls which, in this case, is the wall 8*a*, this first wall having a product-discharge orifice 11 formed therethrough substantially coaxially with the passage 10.

The second of the two walls, in this case the wall 7*a*, has a probe 12 integrally projecting therefrom coaxially with the screw threads 9 and having a front end 12*a* which when the two parts 7 and 9 are screwed tightly together, seats tightly on the inside of the wall 8*a* around the orifice 11 to provide the previously referred to positive orifice shut-off.

Figure 7:
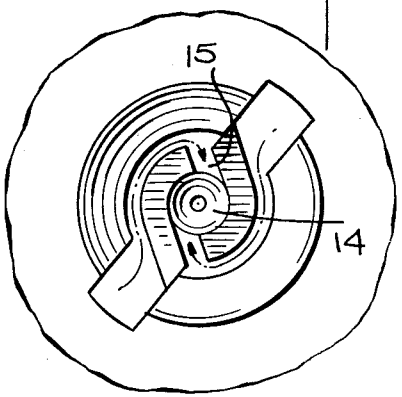
FIG. 7 is a cross section taken on the line VII—VII in FIG. 4.
Figure 6:
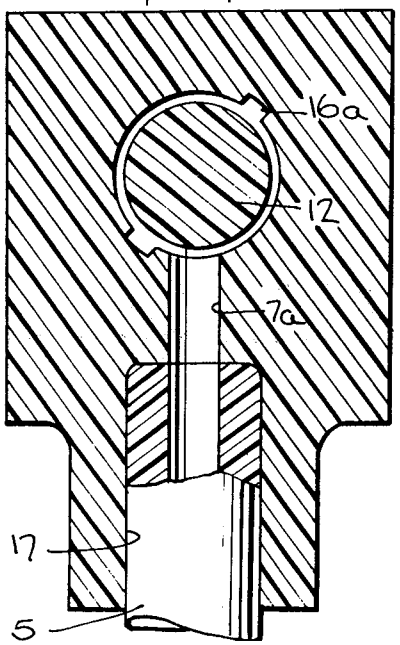
FIG. 6 is a cross section taken on the line VI—VI in FIG. 3.

To provide the swirl chamber, the first wall, in this case 8*a*, has baffles 13 integrally extending therefrom inwardly from around the orifice 11 and forming a cylindrical chamber 14 (see FIG. 7) having at least one, and in this case, two, tangential side inlets 15 which communicate with the passage 10. The front end portion of the probe 12 is made cylindrical as at 16, and this cylindrical portion slidably fits within the baffle walls forming the chamber 14. This is a sliding fit permitting rotation and axial movement of the cylindrical probe portion 16 as the two parts are screwed together and apart. When screwed somewhat apart, the desirable swirl chamber is formed in front of the front end of the probe, the shut-off action being terminated.

In FIG. 3 the two parts 7 and 8 are screwed tightly together with the tip 12*a* of the probe 12 firmly seating on the inside of the wall 8*a* and providing the positive shut-off of the orifice 11. During shipment, and this is of particular importance in the case of the pump-type package, no product can escape from the package. In the case of an aerosol package, inadvertent discharge is positively prevented. Since the part 8 is essentially a screw cap in shape, it can be provided with any of the current child-proof arrangements for preventing it from being unscrewed, just as is now done in the case of screw-top medicine bottles.

In FIG. 4 the two parts are shown as being unscrewed just slightly. Here the chamber 14 is provided a minimum volume, the tangential inlets 15 correspondingly being of minimum area, the result being a spray of very diverging cone shape and fine particle size, the effect of a mist being obtained.

Finally, FIG. 5 shows the two parts screwed apart at their maximum, the tangential inlets 15 being opened now so far that the liquid product can rush in so extensively as to completely fill the swirl chamber with solid liquid which is correspondingly ejected through the orifice in the form of a narrow or concentrated and far-reaching solid stream.

Each type of spray, and variations therebetween, have their desirable characteristics, depending on the product being dispensed and the desire of the user. A swirl chamber of fixed volume and having tangential inlets of fixed area, is normally suitable only for one product operating under one pressure. In the present instance, different products under different pressures and intended for different uses can all be accommodated, because complete redesigning of the swirl chamber is obtained simply by screwing and unscrewing the two parts of the new actuator. Although not previously noted, the male part 7, of course, has the usual hole 17 for press-fitting on any standard tubular stem, such as shown at 5 in FIGS. 1 and 2, this hole communicating with the passage 10 leading to the discharge orifice 11 under control of the parts described.

As illustrated, each of the two parts is a complete and integral plastic molding having a design permitting application of normal injection-molding techniques and mold design practices. For assembly, the two parts only need to be screwed together. Any of the usual plastics used for the manufacture of actuators in general, can be used.

To prevent complete unscrewing of the two parts, the female or cap part 8 is shown as having a nib or lug 18 which, however, may be designed so that the application of torque to the female part or cap 8, exceeding a predetermined value, can permit unscrewing of the parts, this being possibly desirable for cleaning out the actuator in the event the parts are left unscrewed after use, when the package using the actuator contains any of the materials known to cause actuator tip-clogging problems. Such problems are avoided if the new actuator is screwed tightly closed after each use.

Without design difficulties, the two parts may be made so that each is almost solid, avoiding voids or spaces within the actuator in which the product might collect and remain. At the same time, residual product within the actuator becomes unimportant if the two parts are screwed tightly closed with each use of the new actuator.

Figure 8:
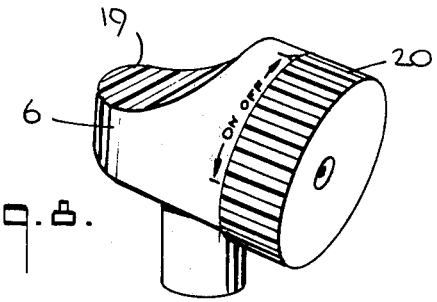
FIG. 8 is a perspective view showing the actuator and indicating how its simple construction permits an attractive external design.
Figure 9:
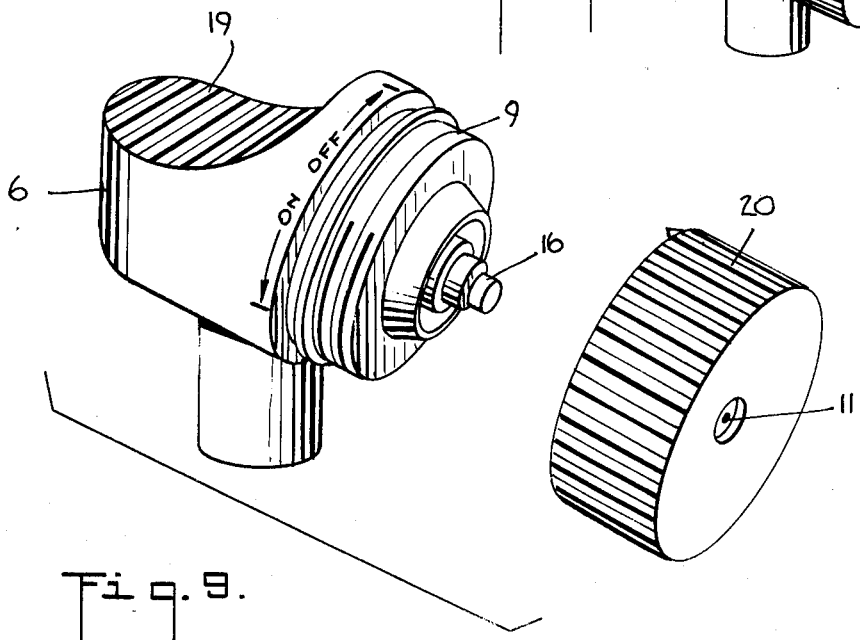
FIG. 9 is the same as FIG. 8 but shows the two parts completely unscrewed and separated from each other.

Because only two parts are involved, the new actuator can be minaturized to the degree required for customer acceptance. Its top may be provided with a knurled finger-surface as indicated at 19, and, of course, the cap or female part 8 can be externally knurled as shown at 20 in FIGS. 8 and 9.

Figure 10:
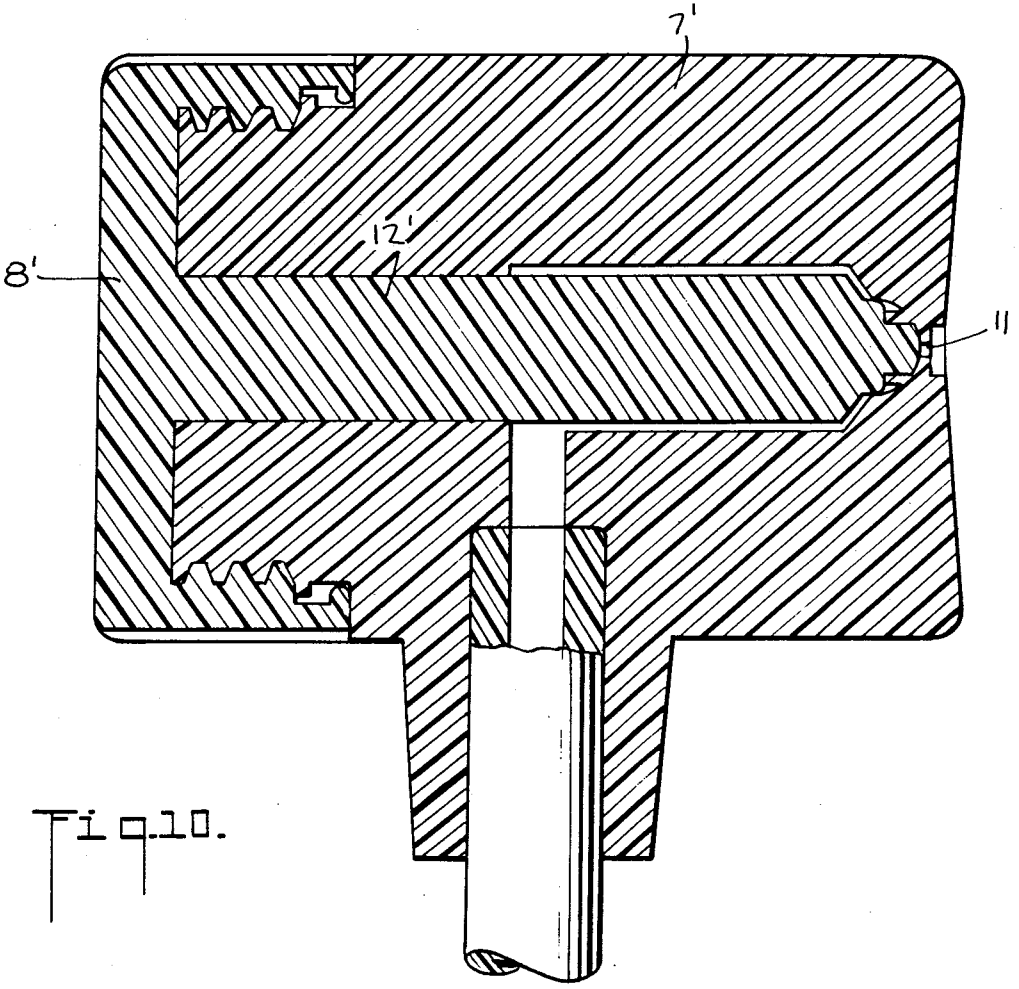
FIG. 10 is a view similar to FIG. 3 but showing a modification.

FIG. 10 is provided to show that the female part or cap 8' can be screwed onto the back end of the male part 7' with the passage through the latter extending from the orifice 11 clear through and out the back end. This permits the female part 8', or cap, to be the one carrying as an integral molded part, the probe 12'. Other than for these differences, the two constructions are substantially the same, each offering its own inherent advantages.

In FIG. 5 the probe is shown as being completely removed from the swirl chamber to show that the latter can be completely flooded with the product. However, ordinarily the parts would not be unscrewed so far as is shown, because even while the probe remains closing the back or inner end of the chamber, it can still be withdrawn so far that the two inlets or orifices 15 provide for flooding the swirl chamber and, therefore, the ejection of a solid stream through the discharge orifice.

This discharge orifice can be fitted with the usual tubular insert when optimum roundness and diameter control, are desired. Such inserts are often pressed into prior art actuator orifices, and may be considered desirable by purchasers of the present two-part actuator.

What is claimed is:

1. A mechanical breakup actuator for a container of fluid product, having a tubular stem through which the product is expelled when the stem is moved, the actuator being attached to the stem for actuation by finger pressure; said actuator comprising male and female parts having screw threads and which are screwed together and form a body having front and back walls, the distance between said walls being variable by screwing the parts back and forth relative to each other, the male part internally forming a passage coaxially with respect to said screw threads and extending to a first one of said walls and that first one of the walls having a product-discharge orifice formed therethrough substantially coaxially with said passage, the second of said walls having a probe projecting therefrom coaxially with said screw threads, through said passage and having a front end which when the parts are screwed tightly together, seats tightly on the inside of said first wall around said orifice to provide a positive orifice shut-off, said first wall having baffles extending therefrom inwardly from around said orifice and forming a cylindrical chamber having at least one tangential side inlet which communicates with said passage, and the front end of said probe being cylindrical and slidably fitting in said chamber so that by said screwing the probe slides back and forth in said chamber to vary the effective flow areas of said inlets, said male part having a hole forming a press-fit with said stem for attachment of the actuator thereto, and this hole opening into said passage to discharge the product therein when the product is expelled from the stem when moved by finger pressure on the actuator.

2. The actuator of claim 1 in which the one of said parts having said first wall and said baffles is formed by an integral plastic molding, and the other of said parts having said second wall and probe is also an integral plastic molding, whereby the actuator is formed solely by the two plastic moldings.

3. The actuator of claim 2 in which the male part has said second wall and the female part has said first wall.

4. The actuator of claim 2 in which the male part has said first wall and the female part has said second wall.

* * * * *